US006394881B1

(12) United States Patent
Watanabe et al.

(10) Patent No.: US 6,394,881 B1
(45) Date of Patent: May 28, 2002

(54) CUT-WIRE TYPE FERROUS SHOT FOR BLASTING AND A PROCESS OF USING A CUT-WIRE TYPE FERROUS SHOT FOR BLASTING

(75) Inventors: Takanori Watanabe, Toyota; Shigeru Murai, Aichi-gun; Noriyuki Murai, Chita; Yoshihiro Watanabe, Ama-gun; Kanehisa Hattori, Nagoya, all of (JP)

(73) Assignee: Toyo Seiko Co., Ltd., Ama-gun (JP)

( * ) Notice: Subject to any disclaimer, the term of this patent is extended or adjusted under 35 U.S.C. 154(b) by 0 days.

(21) Appl. No.: 09/573,168

(22) Filed: May 19, 2000

(51) Int. Cl.[7] ..... B24C 1/00
(52) U.S. Cl. ..... 451/38; 451/39
(58) Field of Search ..... 451/38, 39; 72/53

(56) References Cited

U.S. PATENT DOCUMENTS 4,482,392 A * 11/1984 Pollock et al. ..... 134/7
5,512,006 A * 4/1996 Wood et al. ..... 451/39
6,258,316 B1 * 7/2001 Buenemann, Jr. et al. ..... 420/8

FOREIGN PATENT DOCUMENTS

JP 4-310372 A * 11/1992 ..... B24C/11/00

* cited by examiner

*Primary Examiner*—Joseph J. Hail, III
*Assistant Examiner*—David B. Thomas
(74) *Attorney, Agent, or Firm*—Oblon, Spivak, McClelland, Maier & Neustadt, P.C.

(57) ABSTRACT

The present invention discloses a cut wire method of producing a ferrous shot and a cut-wire type ferrous shot for shot-blasting having a hardness of Hv 200 to 300 and a low work hardening ability. Further, the present invention describes a process of using a cut-wire type ferrous shots, comprising preparing the cut-wire type ferrous shots and a ferrous object and projecting the shots to the ferrous object to remove foreign material from the ferrous object.

68 Claims, 5 Drawing Sheets

CUT-WIRE TYPE FERROUS SHOT FOR BLASTING AND A PROCESS OF USING A CUT-WIRE TYPE FERROUS SHOT FOR BLASTING

BACKGROUND OF THE INVENTION

1. Field of the Invention

The present invention relates to a cut-wire type ferrous shot for shot-blasting.

2. Description of the Related Art

Shot-blasting is a process in which a plurality of ferrous shots are projected to contact ferrous objects at a high speed. Conventionally, shot-blasting has been carried out to remove sand, burrs, and scales from ferrous objects such as castings.

Ferrous shots are made to have a hardness of about Hv 400 to 500 by quenching and tempering ferrous particles produced by an atomization method. The atomization method produces conventional ferrous shots which contain dendritic structures and shrinkage cavities. These dendritic structures and shrinkage cavities promote unavoidable defects within the ferrous shots which cause the ferrous shots to be broken easily. Therefore, the atomization method produces conventional ferrous shots which vary widely in particle size.

Recently, a technique for producing ferrous shots having a hardness of Hv 400 to 500 has been developed. This technique involves serially cutting a steel wire material made of hard steel at a designated length. Therefore, this technique of producing ferrous shots is referred to as a cut-wire type method. Further, a ferrous shot produced from a cut-wire type method is referred to as a cut-wire type shot. Ferrous shots produced by the cut-wire type method are more difficult to break in comparison with the conventional ferrous shots produced by the atomization method. This is due to the presence of forged flows in the cut-wire type shot. Forged flows are formed due to drawing of the steel wire material during the cut-wire type method.

The above-mentioned conventional ferrous shots harden easily due to work-hardening as projection frequency of shot-blasting is increased. As the ferrous shots are used more often and for longer periods of time, the hardness of the ferrous shots increases. This increase in ferrous shot hardness results in an increase in the abrasion of parts mounted onto a shot-blasting machine. Therefore, the parts mounted on the shot-blasting machine require frequent periodical exchange and/or replacement.

The above-mentioned conventional ferrous shots have a high hardness; and therefore, the above-mentioned methods of producing such shots do not prevent the shots from being broken during their projection in shot-blasting. Consequently, the ferrous shots must be consumed and disposed of at a faster pace due to their destruction. Further, the surface layer of the ferrous objects is easily hardened due to work-hardening due to being beaten repeatedly by the ferrous shots during shot-blasting. Finally, there is a limit in the life of tools used for cutting the hardened ferrous objects.

SUMMARY OF THE INVENTION

The overall aim of the present invention is to improve the above-mentioned difficulties related to shot-blasting with ferrous shots.

One object of the present invention to provide a cut-wire type ferrous shot and a process of using a cut-wire type ferrous shot which can decrease the frequency of exchanging and/or replacing the parts mounted on a shot-blasting machine.

Another object of the present invention is to decrease the consumption of ferrous shots during shot blasting.

Another object of the present invention is to increase the life of tools used for cutting ferrous objects.

One object of the present invention is to suppress the abrasion of parts mounted onto a shot-blasting machine while the ferrous shots retain their function of removing foreign material that adhere to ferrous objects. Such foreign material includes sand, burrs, or scales, for example. Such ferrous objects include castings, for example.

Another object of the present invention is to provide ferrous shots having a hardness that is equivalent to, or slightly harder than, the ferrous objects. Such ferrous shots can be cut-wire type ferrous shots having a hardness of Hv 200 to 300.

Another object of the present invention is to provide ferrous shots that have a tendency to hardly be broken; and therefore, suppress abrasion of the ferrous objects.

Another object of the present invention is to provide a ferrous shot, having a hardness of Hv 200 to 300 and a low work hardening ability, for use in shot-blasting. Such ferrous shots are made by cutting a wire material.

In the present invention, "blasting" means both shot-abrading and shot-peening.

Since the shot concerning the present invention has a hardness of Hv 200–300, it can suppress abrasion of parts mounted to the inside of a shot-blasting machine. In addition, the ferrous shot of the present invention tends to resist being broken, thereby decreasing their consumption during the process of shot-blasting. Further, the ferrous shot has a hardness of Hv 200–300, thereby suppressing damage to tools for cutting the ferrous objects, such as casting, after shot-blasting. Therefore, the life of tools used for cutting ferrous objects is increased. Finally, the ferrous shot of the present invention can reduce industrial wastes, thereby improving a working environment.

A process of using a cut-wire type ferrous shot for shot-blasting according to the present invention comprises the steps of:

(1) Preparing cut-wire type ferrous shots for shot-blasting and a ferrous object. The cut-wire type ferrous shots having a hardness of Hv 200 to 300 and a low work hardening ability are made from cutting a wire material. The ferrous object has a foreign material thereon; and (2) projecting the ferrous shots to the ferrous object to remove the foreign material from the ferrous object; wherein work-hardening is suppressed in both the shots and the ferrous object.

The present invention uses the shots having a hardness of Hv 200–300; and therefore, can suppress abrasion of parts mounted onto a shot-blasting machine. Since the shot used according to the present invention tends to not be broken during shot-blasting, the process according to present invention can decrease the consumption of the shots effectively. Further, the process according to the present invention can reduce industrial wastes, thereby improving a working environment. Finally, the process according to the present invention can suppress damage of a tool for cutting the ferrous objects, such as casting, after shot-blasting. Therefore, the process can lengthen the life of the tool.

Preferable Mode of the Present Invention

The cut-wire type ferrous shots have a low average hardness of Hv 200–300 as measured by a micro Vickers hardness tester. An upper limit of the hardness may be, for example, Hv 290, Hv 280 or Hv 270: a lower limit of the hardness may be, for example, Hv 210, Hv 220 or Hv 230. Generally, the hardness from the surface layer to the center portion in a shot is almost equivalent and the above-mentioned shot is set in such a hardness range. The metal structure of the shot is generally ferrite. An area ratio of ferrite can be, for example over 90%, 95% or 98%. However, the area ratio of ferrite is not limited to these values.

The present invention is not limited in the size of the shot. The size of the shot can be set at about 0.5 mm-3 mm, for example. A plurality of cut-wire type shots are produced by serially cutting the steel wire material having an extended length. Prior to use, the shots produced by the cut-wire type method are projected in the shot-blasting machine, thereby providing a ferrous shot with an edge that is rounded in shape. According to the present invention, it is easy to provide a ferrous shot with an edge that is rounded in shape because the shot does not have a high hardness.

The shots concerning the present invention are formed of an iron-carbon alloy. The ferrous shots formed of an iron-based alloy may contain, for example, 0.03–0.15% carbon, and preferably 0.04–0.08% carbon. The ferrous shots formed of an iron-based alloy may contain, for example, less than 0.2% carbon, preferably less than 0.15% carbon, more preferably less than 0.1% carbon, most preferably less than 0.08% carbon, or, especially most preferably less than 0.05% carbon. Therefore, mild steel wire material can be used as a raw material for the shots according to the present invention because such shots reduce the work-hardening ability in a ferrous alloy. The percentages recited herein and above are in terms of a weight ratio.

Also, the ferrous shots formed of an iron-based alloy may contain 0.10–0.40% aluminum (Al), preferably 0.20–0.32% aluminum by weight ratio. An addition of aluminum (Al) can suppress age-hardening after producing the shot. Further, the alloy may contain 0.01–0.04% silicon (Si). Moreover, the alloy may contain 0.10–0.40% manganese (Mn). The ferrous shots formed of an iron-based alloy according to the present invention may contain 0.005–0.030% phosphorus (P) and 0.010–0.030% surfer (S). Generally, the shots produced by a cut-wire type method of the present invention possess less oxide film in comparison with the shots produced by a atomization method.

The process according to the present invention can use a ferrous object having a hardness less than Hv 200, for example a hardness of Hv 150–180.

BRIEF DESCRIPTION OF THE DRAWING

A more complete appreciation of the present invention and many of its advantages will be readily obtained by reading the preferred embodiment while considering the information provided in the drawings, all of which form a part of the disclosure.

DETAILED DESCRIPTION OF THE PREFERRED EMBODIMENT

Having generally described the present invention, a further understanding can be obtained by reference to the specific preferred embodiments which are provided herein for the purpose of illustration only. They are not intended to limit the scope of the present invention, nor the accompanying claims of the present application.

One embodiment of the present application is to provide ferrous shots produced by a cut-wire type method for shot-blasting. Another embodiment of the present application is providing ferrous shots having a low hardness of Hv 200–300. A further embodiment of the present application is to provide a ferrous shot having consistent hardness throughout the ferrous shot. A further embodiment of the present application is to provide a ferrous shot having a hardness that is almost equivalent from the surface layer to the inside of the shot. Further, this hardness is set within the above-mentioned range. The above-mentioned hardness range of the ferrous shots is an average hardness as measured by micro Vickers hardness tester (load: 500 g). An average particle size of this shot was set in a range of 1.7–2.3 mm.

Figure 5:
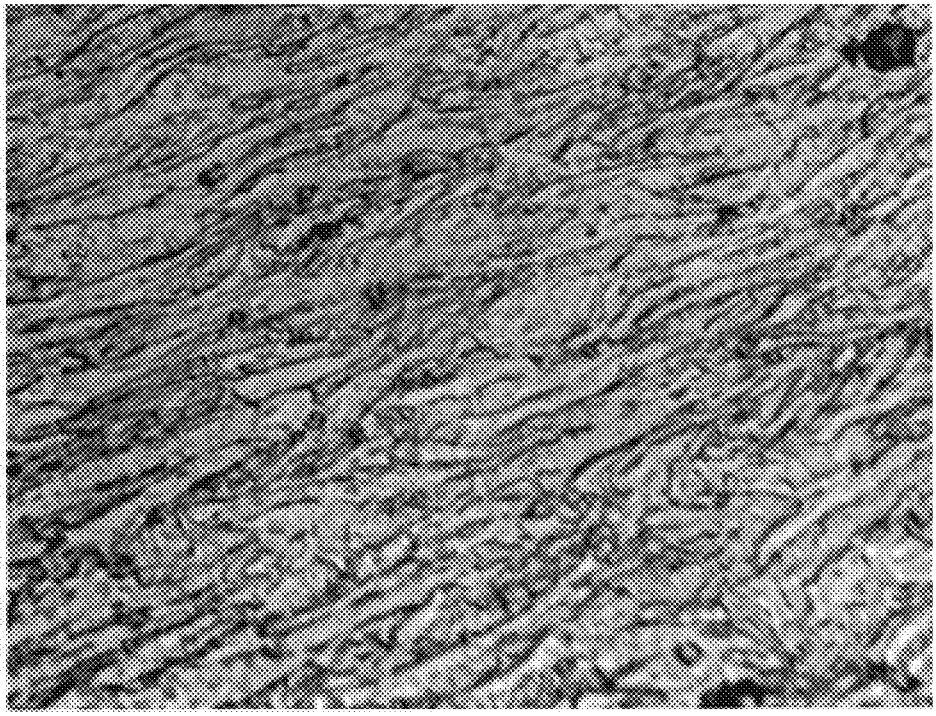
FIG. 5 exhibits a photomicrography which shows a metallic organization of a shot.

FIG. 5 shows a photomicrography (magnification: 900) of the shot having a metal structure immersed with a 2% nitric acid liquid for 60 seconds. As understood from FIG. 5, this metal structure was mainly formed of ferrite and slight pearlite, and this metal structure had forged flows extended in a direction along which a steel wire material was drawn as a starting material of shots.

The ferrous shots were produced as follows. A steel wire material having a diameter of 5.5 mm and a designated composition was contacted with an acid for acid-cleaning in order to remove the surface oxide film of the steel wire material. Afterwards, the steel wire material was continuously drawn with a plurality of dies, 7–8 pieces. This drawing method produced an extended wire having a uniform diameter of 2.0 mm. This extended wire was serially cut in a length of 1.7–2.3 mm to form a plurality of shots. Afterwards, the edge of the shots are rounded by projecting the shots onto walls, etc.

In the present embodiment of the invention, the ferrous shots were projected at a high speed onto a ferrous casting, working as a ferrous object, to remove foreign materials which are known to adhere to the surface of the ferrous casting. Such foreign materials include sand, burrs, or oxide films. The hardness of the surface of the casting was equivalent to, or lower than, that of the ferrous shots. Table 1 shows hardness and elemental compositions of the ferrous shots produced in Examples 1–3.

TABLE 1

| | | Composition of Shot, wt. % | | | | | |
|---|---|---|---|---|---|---|---|
| | hardness | C | Si | Mn | P | S | Al |
| Example 1 | 240–279 | 0.05 | 0.02 | 0.22 | 0.009 | 0.013 | 0.30 |
| Example 2 | 249–273 | 0.04 | 0.02 | 0.22 | 0.017 | 0.013 | 0.25 |
| Example 3 | 226–254 | 0.06 | 0.02 | 0.20 | 0.009 | 0.013 | 0.28 |

Figure 1:
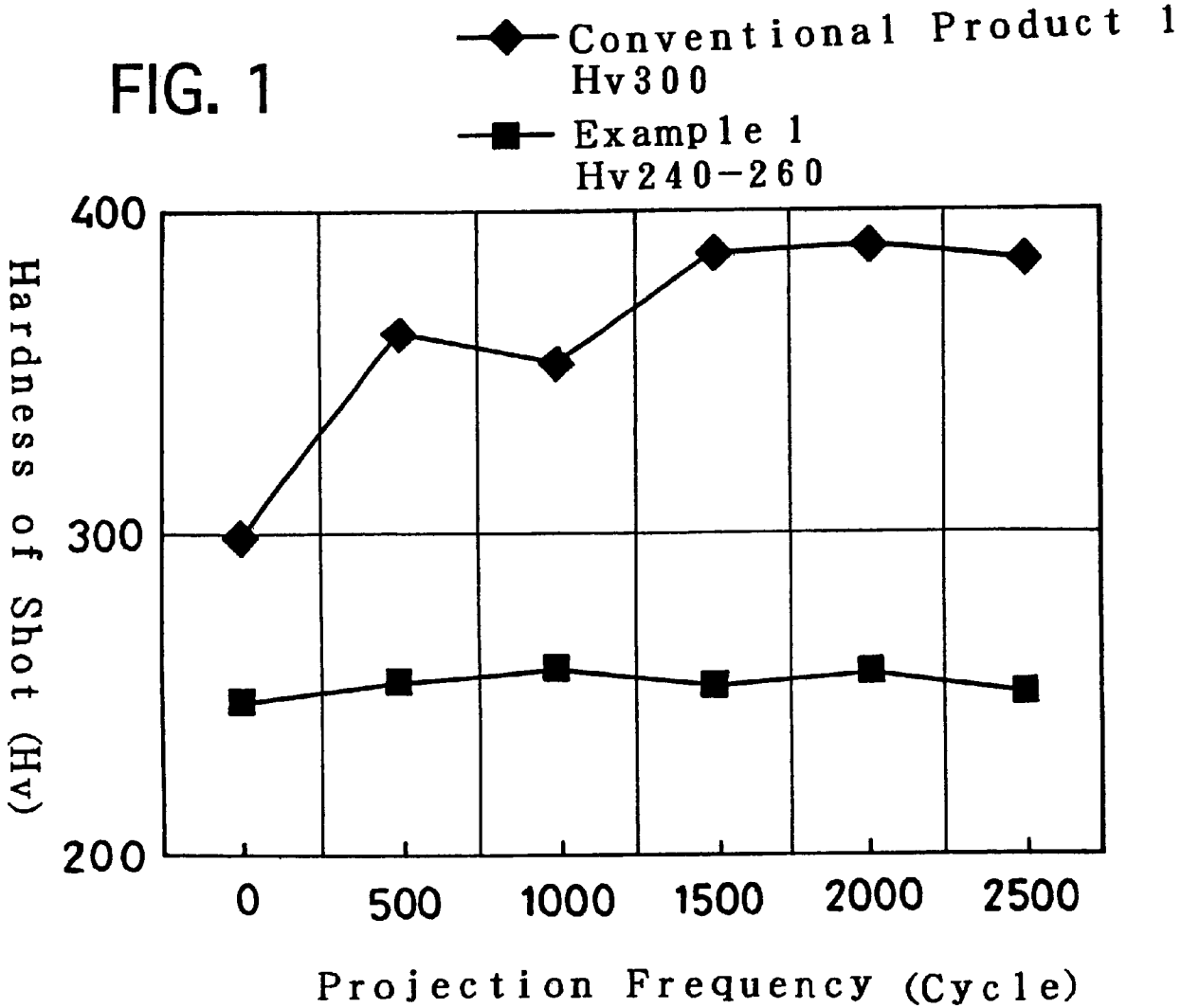
FIG. 1 exhibits a graph which shows a degree of work-hardening of shots in shot-blasting.

FIGS. 1–4 show test results of shot-blasting. FIG. 1 shows the work hardening ability of the ferrous shots of Example 1. In FIG. 1, the horizontal axis shows a projection frequency of the shots, and a vertical axis shows hardness of the shots. The "■" mark shows the shots of Example 1 having a hardness of Hv 240–260. The "◆" mark shows the shots formed by the conventional product 1, produced by the atomization method to have a hardness of Hv 300. The projection speed for projecting the shots was set at about 70 m/s. As shown in FIG. 1, even when the projection frequency of the shots was 500 cycles, the shots formed of the conventional product 1 were rapidly hardened by a work-hardening phenomenon. The shots formed of the conventional product 1 were gradually hardened by work-hardening phenomenon even after 500 cycles. When the projection frequency of the shots exceeded 1000 cycles, the shots formed of the conventional product 1 were increased in hardness by about Hv 100 with respect to an initial hardness thereof. As a result, as shown in FIG. 1, according to the shots formed of the conventional product 1, their hardness approached about Hv 400.

On the other hand, FIG. 1 shows that the shots of Example 1 have a hardness that did not change much even when the projection frequency of the shots was over 2,500 cycles. In short, their hardness almost maintained their initial hardness even after 2,500 cycles. In other words, the shots of Example 1 had a hardness of Hv 240–260 even when the projection frequency of the shots was over 2,500 cycles. FIG. 1 shows that the shots of Example 1 have a rising rate of hardness that is less than 15%, less than 10%, or less than 5%; namely, in the region of about 0–15%, the region of about 0–10%, or the region of 0–5%, when a projection frequency of the shots was set in 2,000–2,500 cycles. Therefore, the shots of Example 1 have a low work-hardening ability. In other words, even when a projection frequency of the shots increases, the shots of Example 1 were difficult to harden, or they did not harden.

Figure 2:
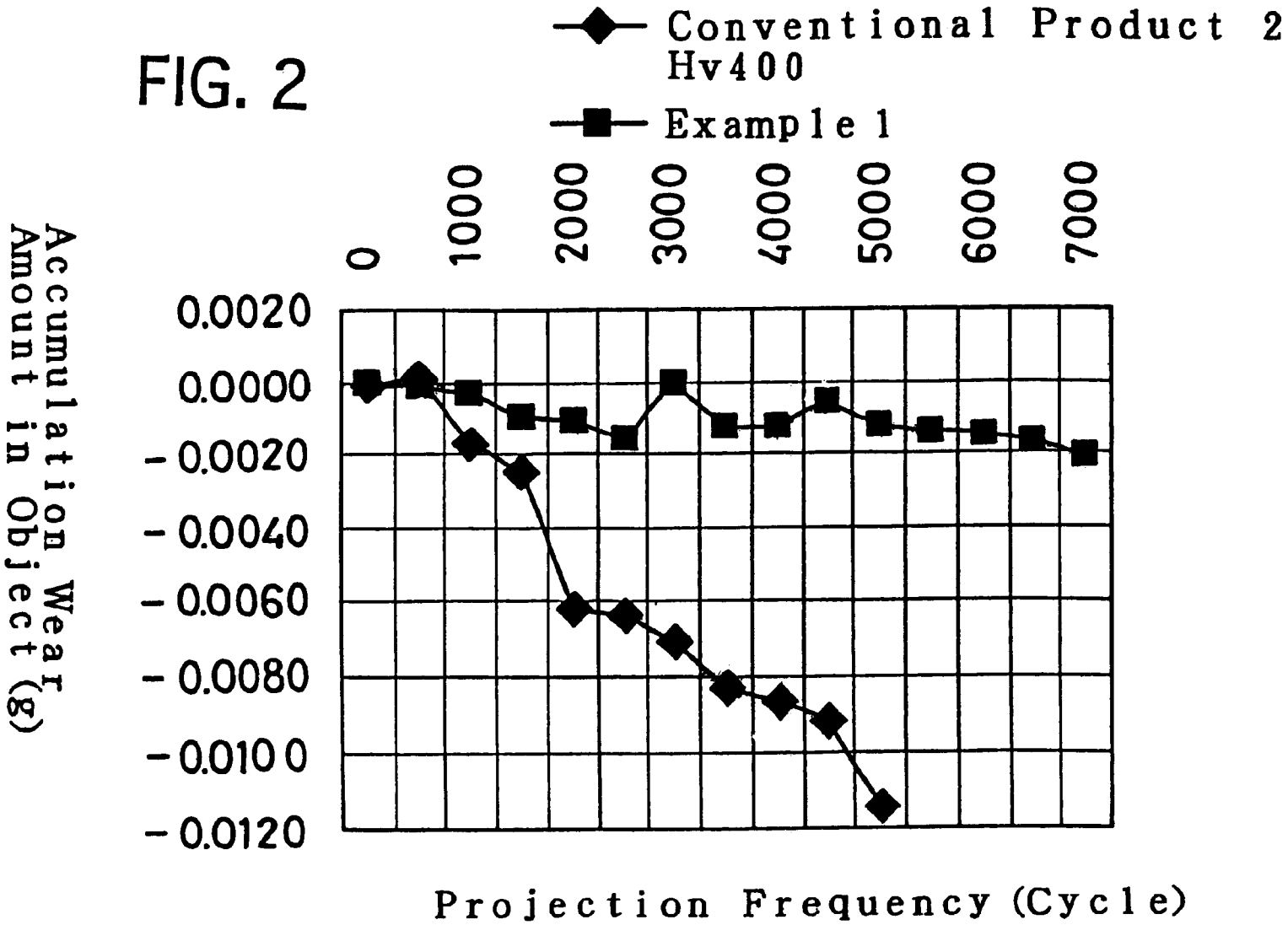
FIG. 2 exhibits a graph which shows an accumulation wear amount of a shot-beaten object in shot-blasting.

FIG. 2 shows the degree wear of a steel plate material, working as a ferrous object, after beaten by the ferrous shots. In FIG. 2, the horizontal axis shows a projection frequency of the shots, and the vertical axis shows the degree of wear of the shot-beaten object. The degree of wear as determined by measuring the amount weight-loss of the steel plate material with an electron balance before and after shot-blasting. In FIG. 2, a "■" mark shows the shot of Example 1, and a "◆" mark shows the shot having a hardness of Hv 400 and formed of a conventional product 2 produced by the atomization method. As shown in FIG. 2, in the shots of the conventional products 2, the degree of wear of the shot-beaten object gradually increased when the projection frequency of the shots was increased. That is, the abrasion was large for the shot-beaten object when the shots of the conventional products 2 were used.

On the other hand, FIG. 2 shows that the degree of wear of the shot-beaten object did not change much, even when the projection frequency exceeded 6000 cycles and 7000 cycles, when using the shots of Example 1. In other words, the degree of wear of the shot-beaten object when using the shot of Example 1 was ⅙–⅛as large as that when the shots of the conventional product 2 was used for shot-blasting. This test result means that parts mounted onto the shot-blasting machine were suppressed in abrasion when using the shots concerning Example 1 in shot-blasting. In addition, this test result means that the life of the parts mounted onto the shot-blasting machine was extended when using the shots concerning Example 1 in shot-blasting.

Figure 3:
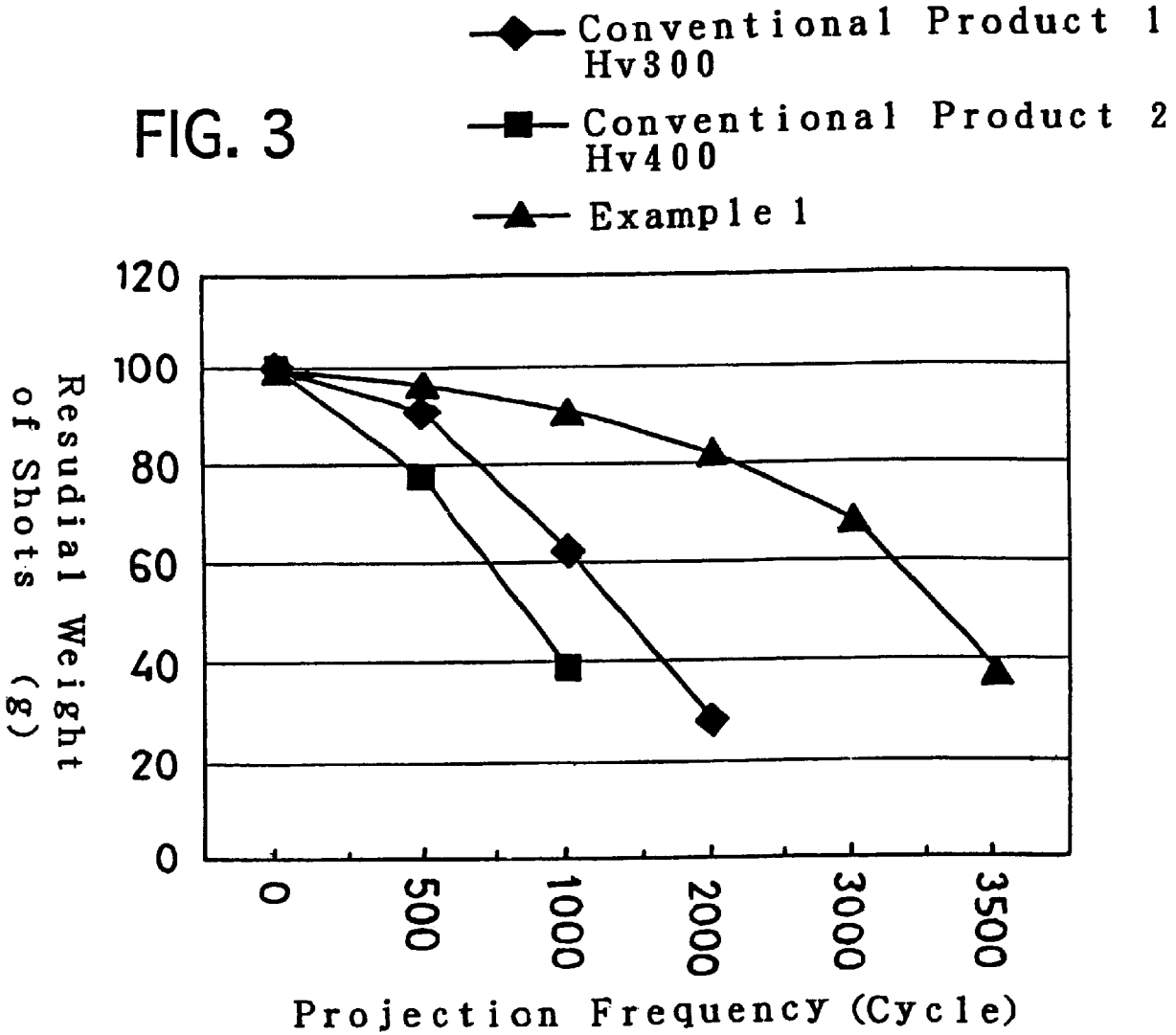
FIG. 3 exhibits a graph which shows a residual weight of the shots in shot-blasting.

FIG. 3 shows life cycles of the shots corresponding to a residual weight of the shots. In this test, the shots of 100 g by weight were projected to the shot-beaten object. In FIG. 3, a horizontal axis shows a projection frequency of the shots, and a vertical axis shows the residual weight of the shots. When the particle size of the shots is destroyed, the shots are to be discarded. In this test, the residual weight was obtained by measuring the particle size distribution after every cycle. In FIG. 3, a "▼" mark shows the shots of Example 1, a "◆" mark shows the shots of the conventional product 1 having a hardness of Hv 300, and a "■" mark shows the shots of the conventional product 2 having a hardness of Hv 400. FIG. 3 shows that when the projection frequency of the shots was increased, the residual weight of the shots of the conventional products 1 and 2 decrease greatly. This is due to cracking and/or breaking of such shots. On the other hand, the residual weight of the shots according to Example 1 was small in comparison with the shots of the conventional products 1 and 2 shots, even when the projection frequency of the shots according to Example 1 increased considerably. FIG. 3 shows that reducing the weight of the shot of conventional product 1 and 2 from 100 g to 50 g required 800–1,600 cycles. However, 3,200 cycles are required to get an equal reduction in weight of the shot of Example 1. Therefore, the shot-life of the shots according to Example 1 are about 2–4 times as long as the shot of conventional product 1 and 2.

Figure 4:
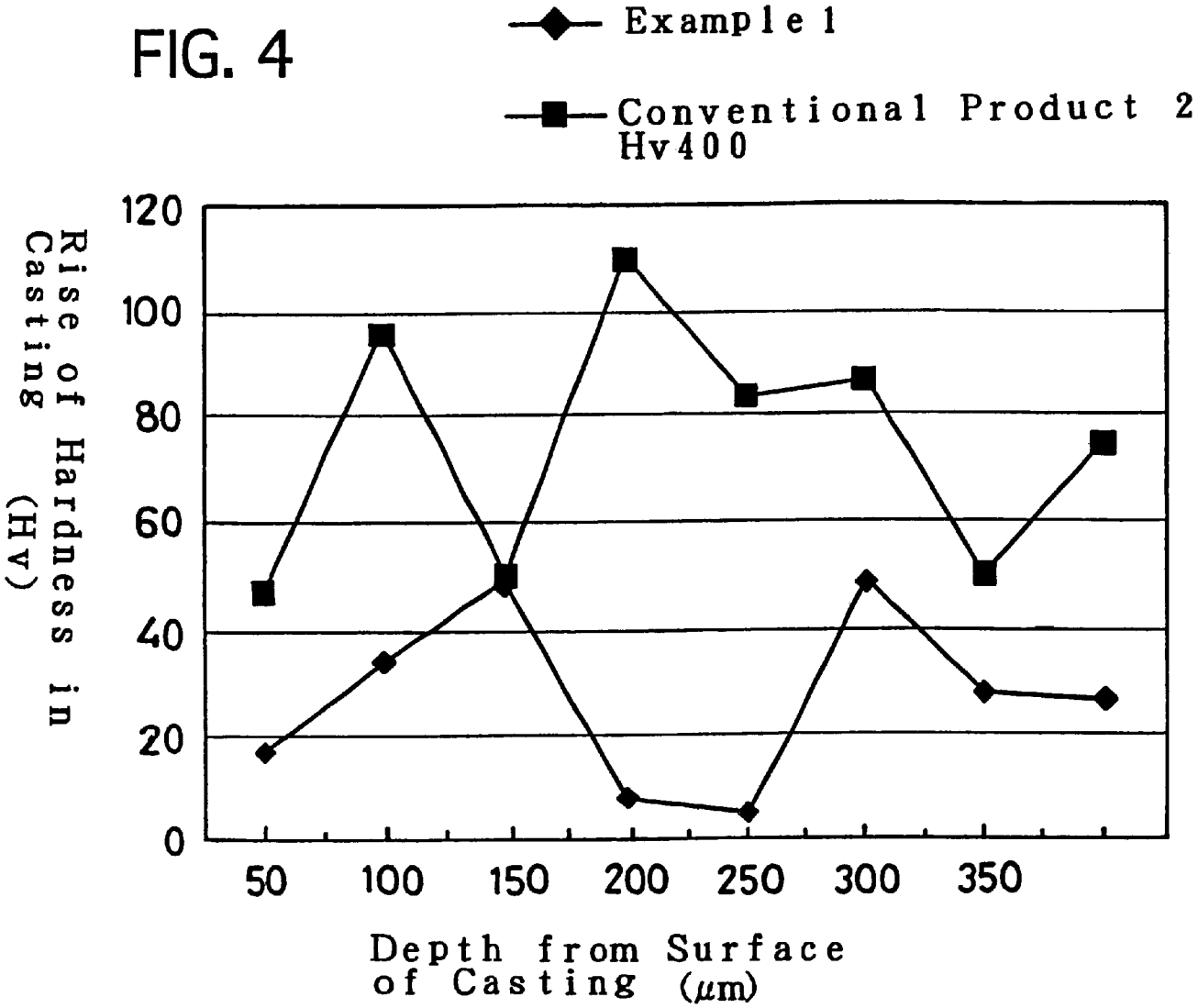
FIG. 4 exhibits a graph which shows a rise in hardness of a casting before and after shot-blasting.

FIG. 4 shows the degree of the work hardening of a ferrous object (i.e. a casting which was formed of cast iron having nodular graphites, an equivalent of FCD 450) after being beaten by shots for 30 minutes. A horizontal axis of FIG. 4 shows the depth from the surface of the casting. A vertical axis FIG. 4 shows a rise of hardness; namely, a hardness difference measured by subtracting a hardness of the casting before shot-blasting from the hardness of the casting after shot-blasting. In FIG. 4, a "◆" mark shows the shots of Example 1, and a"■" mark shows the shots of the conventional product 2 having a hardness of Hv 400. FIG. 4 shows the conventional product 2 produces a large difference in hardness of the casting after shot-blasting, while the shots of Example 1 produces a small difference in hardness of the casting after shot-blasting. In fact, shots according to Example 1 produced a change in hardness of the casting of about Hv 40–60 lower than that produced from the conventional product 2. Therefore, the shots of Example 1, which are of the present invention, were more resistant to hardening, which reduces the hardening of the shot-beaten casting.

The shots according to Example 1 had a low hardness; and therefore, abrasion was suppressed in the parts mounted onto the shot-blasting machine. In addition, shots according to Example 1 were broken down less easily. Therefore, the life of the shots according to Example 1 was extended and their consumption was advantageously decreased. Since the shots according to Example 1 were broken down less easily, industrial wastes were advantageously reduced and a work environment was advantageously improved.

Work-hardening of the ferrous casting, as a result of shot-blasting, was also reduced. Therefore, over-hardening due to shot-blasting was suppressed in the casting, which suppressed damage of tools for cutting the casting after shot-blasting; and, the life of the tool for cutting the casting was lengthened.

The diameter and length of the above-mentioned steel wire material used in a cut-wire method to prepare a cut-wire type ferrous shot are not limited in the present invention.

What is claimed is:

1. A cut-wire type ferrous shot for shot-blasting, comprising a hardness of from Hv 200 to 300 and a low work hardening ability, wherein said ferrous shot is made by a process of cutting a wire material.

2. The cut-wire type ferrous shot according to claim 1, wherein said shot is made by serially cutting a drawn steel wire material comprising essentially a uniform diameter.

3. The cut-wire type ferrous shot according to claim 1, wherein a metallic structure of said shot has forged flows extended along a direction of said shot.

4. The cut-wire type ferrous shot according to claim 1, wherein said shot comprises a rounded edge.

5. The cut-wire type ferrous shot according to claim 1, comprising an iron-carbon alloy.

6. The cut-wire type ferrous shot according to claim 1, comprising less than 0.15% carbon by weight ratio.

7. The cut-wire type ferrous shot according to claim 1, comprising less than 0.08% carbon by weight ratio.

8. The cut-wire type ferrous shot according to claim 1, comprising from 0.10 to 0.40% aluminum by weight ratio.

9. The cut-wire type ferrous shot according to claim 1, comprising from 0.01 to 0.04% silicon by weight ratio.

10. The cut-wire type ferrous shot according to claim 1, wherein a metallic structure of said shot comprises ferrite.

11. The cut-wire type ferrous shot according to claim 1, wherein a hardness of said shot increases by less than 15% when a projection frequency of said shot is 2,500 cycles.

12. A process of using a cut-wire type ferrous shot for shot-blasting, comprising the steps of:

preparing cut-wire type ferrous shots for shot-blasting, said cut-wire type ferrous shot having a hardness of Hv 200 to 300 and a low work hardening ability, wherein said ferrous shot is made by a process of cutting a wire material;

preparing a ferrous object, said ferrous object having a foreign material; and projecting said shot to said ferrous object to remove said foreign material from said ferrous object;

wherein work-hardening is suppressed in both of said shots and said ferrous object.

13. The process according to claim 12, wherein a surface of said ferrous object comprises an average hardness of less than Hv 200.

14. The process according to claim 12, wherein said shot is made by serially cutting a drawn steel wire material comprising essentially a uniform diameter.

15. The process according to claim 12, wherein a metallic structure of said shot has forged flows extended along a direction of said shot.

16. The process according to claim 12, wherein said shot comprises a rounded edge.

17. The process according to claim 12, wherein said shot comprises an iron-carbon alloy.

18. The process according to claim 12, wherein said shot comprises less than 0.15% carbon by weight ratio.

19. The cut-wire type ferrous shot according to claim 1, comprising a hardness of from Hv 200 to Hv 290.

20. The cut-wire type ferrous shot according to claim 1, comprising a hardness of from Hv 200 to Hv 280.

21. The cut-wire type ferrous shot according to claim 1, comprising a hardness of from Hv 200 to Hv 230.

22. The cut-wire type ferrous shot according to claim 1, comprising a hardness of from Hv 210 to 300.

23. The cut-wire type ferrous shot according to claim 1, comprising a hardness of from Hv 220 to Hv 300.

24. The cut-wire type ferrous shot according to claim 1, comprising a hardness of Hv 230to Hv 300.

25. The cut-wire type ferrous shot according to claim 1, comprising from 0.20% to 0.32% aluminum by weight ratio.

26. The cut-wire type ferrous shot according to claim 1, comprising from 0.1% to 0.40% manganese by weight ratio.

27. The cut-wire type ferrous shot according to claim 1, comprising from 0.005% to 0.030% phosphorus by weight ratio.

28. The cut-wire type ferrous shot according to claim 1, comprising from 0.010% to 0.030% sulfur by weight ratio.

29. The cut-wire type ferrous shot according to claim 1, comprising a size from 0.5 mm to 3 mm.

30. The cut-wire type ferrous shot according to claim 1, comprising a size from 1.7 mm to 2.3 mm.

31. The cut-wire type ferrous shot according to claim 1, comprising less than 0.2% carbon by weight ratio.

32. The cut-wire type ferrous shot according to claim 1, comprising less than 0.1% carbon by weight ratio.

33. The cut-wire type ferrous shot according to claim 1, comprising from 0.03% to 0. 15% carbon by weight ratio.

34. The cut-wire type ferrous shot according to claim 1, comprising from 0.04% to 0.08% carbon by weight ratio.

35. The cut-wire type ferrous shot according to claim 1, comprising an area ratio of ferrite of not less than 98%.

36. The cut-wire type ferrous shot according to claim 1, comprising an area ratio of ferrite of not less than 95%.

37. The cut-wire type ferrous shot according to claim 1, comprising an area ratio of ferrite of not less than 90%.

38. The cut-wire type ferrous shot according to claim 6, comprising an area ratio of ferrite of not less than 90%.

39. The cut-wire type ferrous shot according to claim 38, comprising from 0.10% to 0.40% aluminum by weight ratio.

40. The process according to claim 12, wherein a surface of said ferrous object comprises an average hardness of from Hv 150 to Hv 180.

41. The process according to claim 12, wherein said ferrous object comprises cast iron.

42. The process according to claim 12, wherein said ferrous object comprises cast iron having nodular graphites.

43. The process according to claim 12 wherein said shot comprises less than 0.1% carbon by weight ratio.

44. The process according to claim 12, wherein said shot comprises less than 0.08% carbon by weight ratio.

45. The process according to claim 12, wherein said shot comprises from 0.03% to 0.15% carbon by weight ratio.

46. The process according to claim 12, wherein said shot comprises from 0.04% to 0.08% carbon by weight ratio.

47. The process according to claim 12, wherein said shot comprises from 0.10 to 0.40% aluminum by weight ratio.

48. The process according to claim 12, wherein said shot comprises from 0.20% to 0.32% aluminum by weight ratio.

49. The process according to claim 12, wherein a hardness of said shot increases by less than 15% when a projection frequency of said shot is 2,500 cycles.

50. The process according to claim 12, wherein said shot comprises from 0.10% to 0.40% manganese by weight ratio.

51. The process according to claim 12, wherein said shot comprises from 0.005% to 0.030% phosphorus by weight ratio.

52. The process according to claim 12, wherein said shot comprises from 0.010% to 0.030% sulfur by weight ratio.

53. The process according to claim 12, wherein said shot comprises an hardness of from Hv 200 to Hv 290.

54. The process according to claim 12, wherein said shot comprises a hardness of from Hv 200 to Hv 280.

55. The process according to claim 12, wherein said shot comprises a hardness of from Hv 200 to Hv 230.

56. The process according to claim 12, wherein said shot comprises a hardness of from Hv 210 to Hv 300.

57. The process according to claim 12, wherein said shot comprises a hardness of from Hv 220 to Hv 300.

58. The process according to claim 12, wherein said shot comprises a hardness of from Hv 230 to Hv 300.

59. The process according to claim 12, wherein said shot comprises a metallic structure of said shot comprises ferrite.

60. The process according to claim 12, wherein said shot comprises an area ratio of ferrite of not less than 90%.

61. The process according to claim 12, wherein said shot comprises an area ratio of ferrite of not less than 95%.

62. The process according to claim 12, wherein said shot comprises an area ratio of ferrite of not less than 98%.

63. The process according to claim 12, wherein said shot comprises a size from 0.5 mm to 3 mm.

64. The process according to claim 12, wherein said shot comprises a size from 1.7 mm to 2.3 mm.

65. The process according to claim 12, wherein said shot comprises from 0.01% to 0.04% silicon by weight ratio.

66. The process according to claim 12, wherein said shot comprises less than 0.2% carbon by weight ratio.

67. The process according to claim 18, wherein said shot comprises an area ratio of ferrite of not less than 90%.

68. The process according to claim 67, wherein said shot comprises from 0.10% to 0.40% aluminum by weight ratio.

* * * * *